United States Patent [19]

Bergmark

[11] 4,316,050

[45] Feb. 16, 1982

[54] EARTH GROUND ASSEMBLY COMPRISING A DRIVING POINT, A DRIVING ROD, AND A CONTINUOUS CONDUCTOR WIRE

[75] Inventor: Lars M. Bergmark, Skelleftea, Sweden

[73] Assignee: F S Elteknik AB, Skellaftea, Sweden

[21] Appl. No.: 174,343

[22] Filed: Jul. 31, 1980

Related U.S. Application Data

[63] Continuation of Ser. No. 940,148, Sep. 6, 1978, abandoned.

[30] Foreign Application Priority Data

Sep. 14, 1977 [SE] Sweden ..... 7710314

[51] Int. Cl.[3] ..... H01R 4/66

[52] U.S. Cl. ..... 174/7; 403/280; 403/282

[58] Field of Search ..... 174/6, 7; 339/14 R, 339/14 L, 244 R, 247, 273 R, 273 F; 52/155, 156, 165, 166; 175/22; 403/206, 215, 274, 280, 282, 396; 405/244

[56] References Cited

U.S. PATENT DOCUMENTS

| | | | |
|---|---|---|---|
| 642,169 | 1/1900 | Stokes | 174/7 |
| 2,384,338 | 9/1945 | Rasso | 174/7 X |
| 3,060,257 | 10/1962 | Spurgeon | 174/7 |
| 3,249,908 | 5/1966 | Fuller et al. | 339/247 X |

FOREIGN PATENT DOCUMENTS

| | | | |
|---|---|---|---|
| 569907 | 7/1961 | Belgium | 174/7 |
| 643743 | 8/1964 | Belgium | 174/7 |
| 1935373 | 1/1971 | Fed. Rep. of Germany | 339/273 F |
| 7508718 | 1/1977 | Netherlands | 174/7 |
| 124102 | 3/1919 | United Kingdom | 174/7 |
| 1016646 | 1/1966 | United Kingdom | 174/7 |

*Primary Examiner*—Laramie E. Askin

*Attorney, Agent, or Firm*—Cushman, Darby & Cushman

[57] ABSTRACT

An earth ground assembly includes: a tubular driving point in the form of a sleeve; a drive rod fitting into the upper end of the sleeve and having an edge-shaped section which clamps a conductor wire against the inside of the sleeve, the upper end of the sleeve having an outwardly extending lip through which the conductor wire extends; and joint tubes arranged end-to-end to form an extension on the drive rod.

1 Claim, 4 Drawing Figures

EARTH GROUND ASSEMBLY COMPRISING A DRIVING POINT, A DRIVING ROD, AND A CONTINUOUS CONDUCTOR WIRE

This is a continuation of application Ser. No. 940,148 filed Sep. 6, 1978, now abandoned.

This invention relates to an electrical grounding apparatus for driving a ground wire into the ground.

For earthing, i.e. for connecting an electric conductor, and especially a high-voltage-conductor, with earth, the ground rod used in almost all cases consists of externally copper-plated steel tubes, which, are lowered into the ground until the necessary electric connection with earth has been obtained. In order to obtain good electric connection with earth, a drive-in depth of often 50 m and sometimes of more than 100 m is required. As it is not feasible to use in such cases a single integral tube, the copper-plated steel tubes must be jointed as they are being driven into the ground. Such copper-plated steel tubes usually are sections of 1 to 2 m length, which implies that a driven-in ground rod consisting of such jointed steel tube sections comprises a great number of joints, each of which yields a transfer resistance and thereby substantially reduces the conductivity, in any case when compared with an integral ground rod. The copper-plating of these steel tubes, furthermore, is subjected to heavy stresses when the tubes are being driven into the ground, which often results in that the copper-plating is worn off along certain portions of greater or smaller size. This also contributes to a deterioration of the conductivity of the known type of ground rods. It also was found, that the conductivity can be reduced by the aforesaid factors to such an extent that several such ground rods consisting of copper-plated steel tubes must be driven in instead of only one. This involves substantially higher costs, especially because the copper-plated steel tubes per se are very expensive.

the present invention, therefore, has the object to overcome the aforesaid disadvantages and to bring about a device which renders it possible to lower a ground wire into the ground without having to joint the same and without negatively affecting its conductivity, and at a cost which is substantially lower than it has been possible heretofore.

Figure 1:
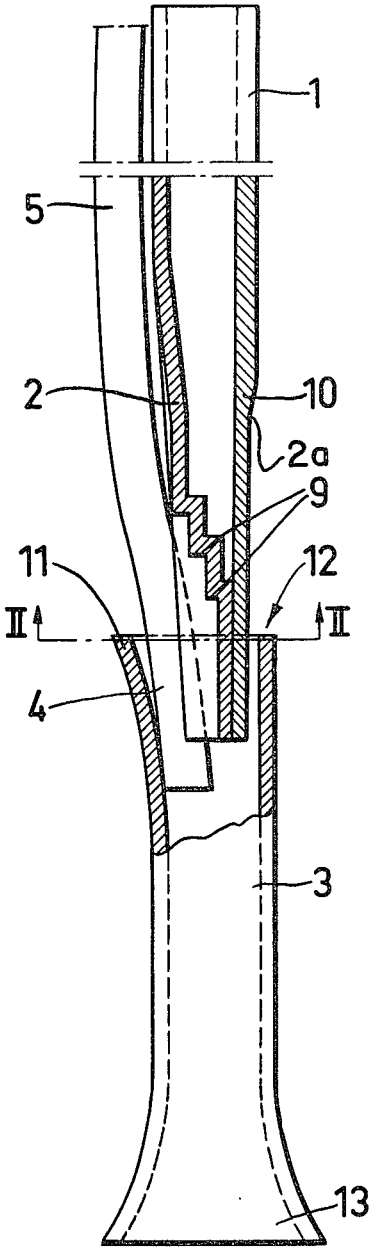
Figure 4:
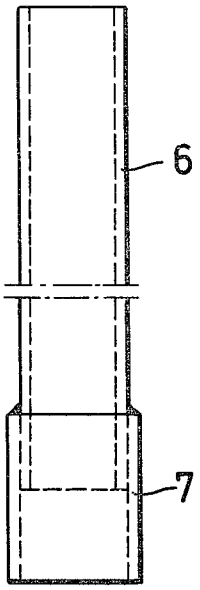
Figure 3:
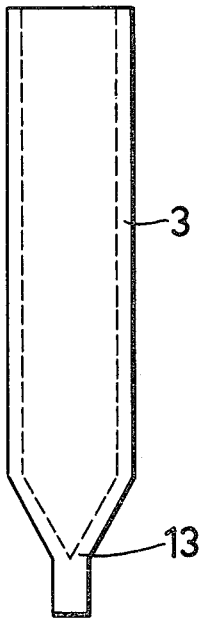
Figure 2:
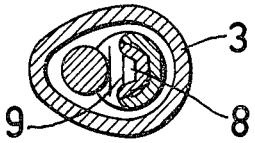

The invention is described in greater detail in the following, with reference to the accompanying drawing, in which FIG. 1 is a lateral view, partially in section, of the device according to the invention, FIG. 2 is a section along the line II—II in FIG. 1, FIG. 3 is a view of a locking sleeve comprised in the device according to the invention, and FIG. 4 is a lateral view of a jointed tube.

The device according to the invention is used to drive a ground wire into the ground as follows. the ground wire is lowered into the ground in the form of a coherent, bare copper wire or corresponding wire by means of the device, which is extensible by joint tubes and driven in, with the wire running on the outside of the joint tubes, by some per se known equipment suited for this purpose. Hereby no jointing of the ground wire is required, and the ground wire in general is not subjected to anything which possibly may negatively affect its conductivity. For the drive-in, furthermore, joint tubes of relatively low quality can be used, which implies a substantial cost saving compared with copper-plated steel tubes for effecting earthing.

The attached drawing shows a preferred embodiment of the device according to the invention. This device comprises a drive-in device or member, which in the embodiment shown is assembled of two parts, viz. a rod 1, which at one end is substantially wedge-shaped, and a locking sleeve 3 for co-operation with the wedge-shaped portion 2 of said rod 1, which sleeve has an inner cross-sectional area which substantially corresponds to the original outer cross-sectional area of the rod with respect both to dimensions and form. Said locking sleeve 3 to be applied about the wedge-shaped portion of the rod, more precisely, shall have such a shape that when the rod is being driven into the ground, said sleeve is pressed in the direction to the rod 1 and thereby is forced to clamp the end 4 of the coherent wire 5 used as ground wire, which end is inserted into the sleeve, against the wedge-shaped portion 2 of the rod, so that the wire 5 is immovably secured. Thus, during continued drive-in of the rod 1, extensible by joint tubes 6 of the type shown in FIG. 4 and provided with a joint sleeve or pin (not shown), the wire 5 is lowered into the ground on the outside of the joint tubes by the drive-in device. The lower end of each joint tube 6 is formed as a socket 7.

The rod 1 is shown in the drawing in the form of a tube, the wedgeshaped portion 2 of which is brought about by impressing a portion of the tube, which impression has an arc-shaped cross-section and a depth increasing toward the end of the tube, so that the tube along the wedge-shaped portion 2 has a depression 8 of arc-shaped cross-section for the wire end 4, which depression by a total compression of the tube at the end there has a substantially semi-cylindric shape and, thus, in the direction therefrom has decreasing depth and finally terminates entirely. simultaneously with said impressing of the tube, preferably also a number of projections 9 are formed which are located one after the other in the depression 8 and act as barbs or other hold-improving members. Said projections are located offset relative to each other and, thus, have a projecting length, which increases in the direction from the end, counted from the tube wall 10, which is not impressed. On the side of the rod 1 opposite the depression 8 is a longitudinally-extending portion **2*a* of reduced cross-section in order to further reduce the cross-sectional area of the rod 1 at its lower end portion. The length of the sleeve 3 is greater than the length of the portion 2*a*. Upon clamping the wire end 4, said projections 9 are presses into the wire and thereby improve the hold very substantially, so that the wire safely is secured. In order to prevent the wire end 4 lying in said depression 8 in the tube from being damaged by the locking sleeve 3 when the sleeve is forcibly moved to clamp the wire, the locking sleeve is provided with an outwardly extending lips 11 at its upper end 12, through which the wire 5** extends.

As the locking sleeve 3, or driving point, is that portion of the drive-in device which is located first in the drive-in direction, it is formed with a tip 13, which according to the invention shall have a greatest width, which at least is greater than the original width of the rod 1, in order at the driving-in operation to provide space for the wire 5. It is to be observed, however, that the tip must not be so great as to deteriorate or neglect the earth contact of the wire. The tip of the locking sleeve preferably is shaped as a planar tip as shown in the drawing, where the tip 13 and the tip 11 should be located in one and the same plane.

What I claim is:

1. Electrical grounding apparatus comprising an electrical ground conductor in the form of a continuous conductor wire, driving means in the form of a tubular driving rod arranged to be driven into the ground, a tubular driving point surrounding the lower end portion of the driving rod for connecting said wire to said driving rod by clamping the lower end portion of said wire to said lower end portion of said driving rod to thereby carry the wire when the driving rod is driven into the ground, said driving point having an upper portion provided with an outwardly extending lip through which the conductor wire extends and said driving point having a lower portion terminating below the lower end portion of the driving rod, a plurality of joint rod sections for extending the driving rod in length as the latter is driven into the ground with the continuous conductor wire extending along the outside of the driving rod and the connected joint rod sections, said driving rod having at the lower end portion a laterally facing curved depression receiving the lower end portion of the conductor wire, said depression being formed with stepped projections located in sequence in the axial direction of the driving rod and said depression extending axially and decreasing in depth toward zero in a direction opposite to the driving direction, said driving rod having a longitudinally extending portion of reduced cross-section arranged opposite said depression in order to further reduce the cross-sectional area of the driving rod at its end portion, said driving point having a length greater than the length of said portion of reduced cross-section and being formed at its lower end with a planar tip disposed below the lower end of the driving rod and having a width exceeding the width of at least those portions of the driving means along the outside of which the conductor wire extends, said planar tip being arranged in the same plane as said outwardly extending lip in the upper portion of the driving point, said driving point surrounding that portion of the driving rod having said depression and said portion of reduced cross-section, and said driving point also surrounding a straight portion of the conductor wire which is in said depression to jam the conductor wire firmly against the bottom of said depression and its stepped projections.

* * * * *